United States Patent [19]

Rada et al.

[11] Patent Number: 5,012,054

[45] Date of Patent: Apr. 30, 1991

[54] CLOSELY SPACED BACK-LIT PUSH BUTTON ARRAY

[75] Inventors: Mark Z. Rada; John W. Willis; Marta E. Stewart, all of Kokomo, Ind.

[73] Assignee: Delco Electronics Corporation, Kokomo, Ind.

[21] Appl. No.: 522,696

[22] Filed: May 14, 1990

[51] Int. Cl.[5] ..... H01H 9/16

[52] U.S. Cl. ..... 200/314; 200/5 A; 200/DIG. 47; 200/311

[58] Field of Search ..... 200/310, 311, 313, 314, 200/344, 296, 506, 5 A, DIG. 47, 511, 520, 517

[56] References Cited

U.S. PATENT DOCUMENTS

| | | | |
|---|---|---|---|
| 2,265,124 | 12/1941 | Andres | 200/314 |
| 3,169,506 | 2/1965 | Morris | 200/314 |
| 4,385,221 | 5/1983 | Dorfler | 200/310 |
| 4,920,243 | 4/1990 | Yuge | 200/310 |

FOREIGN PATENT DOCUMENTS

| | | | |
|---|---|---|---|
| 2140210 | 11/1984 | United Kingdom | 200/314 |
| 2096395 | 10/1987 | United Kingdom | 200/314 |
| 2201038 | 8/1988 | United Kingdom | 200/310 |

*Primary Examiner*—Henry J. Recla
*Assistant Examiner*—Glenn T. Barrett
*Attorney, Agent, or Firm*—Mark A. Navarre

[57] ABSTRACT

A back-lit push button array which permits close spacing of the buttons while preventing light leaks between the buttons. The buttons are individually keyed into the outer shell of a housing to provide lateral support while permitting axial movement, and interleaving laterally extending features are formed on juxtaposed sidewalls of the buttons within the housing to prevent interbutton light leaks. This permits the buttons to be spaced very closedly, and there is no limitation on the size of the symbols or legends other than the dimensions of the button face itself.

4 Claims, 2 Drawing Sheets

CLOSELY SPACED BACK-LIT PUSH BUTTON ARRAY

This invention relates to an array of closely spaced push buttons having back-lit indicia on the face of the buttons.

BACKGROUND OF THE INVENTION

Push button arrays have been increasingly employed in vehicle control panels as an interface between the operator and a vehicle system, such as a climate control system. Legends and symbols formed on the face of the various buttons are preferably illuminated from behind, or back-lit, for convenient operation under low-ambient lighting conditions. To minimize cost and heating, multiple buttons are typically illuminated with a single lightpipe passing through the array behind the button faces.

In order to increase the number of buttons in a given area, or to group the buttons for function differentiation, it may be desired to space the buttons very closely. In conventional push button arrays however, a spacing limitation arises due to the use of a light-trapping wall formed between adjacent buttons. This is best illustrated in reference to FIG. 1, which depicts a conventional serial array of three push buttons 10, 12 and 14. The buttons 10–14 are assembled into individual cavities formed in a molded housing defined by an outer shell 16 and one or more compartment walls 18, and are supported for limited axial movement therein. The face 20 of each respective button 10–14 protrudes through an aperture in the outboard face 22 of the cavity, outboard movement of the buttons 10–14 being limited by engagement of laterally and longitudinally extending button surfaces 24 with complementary flanges 26 formed on the outer shell 16 and compartment walls 18.

The buttons 10–14 are retained in the housing by a switch array comprising a circuit board 28 and an elastomeric membrane 30. The membrane 30 defines a raised dome 32 which contacts the inboard end of each button 10–14, resiliently urging the buttons 10-14 to their outboard travel limits. The circuit board 28 carries a pair of conductive paths 34 under each dome 32, and a conductive pad 36 in the center of each dome 32 is provided to engage and bridge the conductive paths 34 when the respective button 10–14 is depressed.

A stationary elongated lightpipe 38 adapted to be illuminated by a lamp 40 passes through the buttons 10–14 and compartment walls 18, illuminating the interior of each button 10–14 when the lamp 40 is lit. The face of each button 10–14 is generally opaque except for a translucent area (not shown) defining a symbol or legend to be illuminated in low ambient conditions. When the lamp 40 is lit, light from the lightpipe 38 shines through the translucent areas on the faces of the buttons 10–14, illuminating the symbols and legends for convenient viewing by the operator of the vehicle.

During low ambient conditions when the lamp 40 is lit, the lateral overlap between the button surfaces 24 and the housing flanges 26 operates to prevent light from shining through the area between adjacent buttons. Generally, an overlap of at least 1.0 mm is required. This overlap limits how closely the butlons 10–14 may be spaced. Referring to FIG. 1, for example, it will be seen that the buttons 10–14 may be spaced no closer that approximately three times the required flange overlap, or about 3.0 mm.

One known technique for addressing the above-described limitation without actually changing the spacing of the buttons is to laterally extend the outboard faces of the buttons, giving the appearance of close spacing. However, this does not increase the number of buttons that can be placed in a given area, and further, the legends or symbols can only be deployed in the center of the button.

SUMMARY OF THE PRESENT INVENTION

The present invention is directed to an improved push button array which permits, close spacing of the buttons while substantially preventing light leaks between the buttons. According to the invention, there are no housing compartment walls between the buttons. Instead, the buttons are individually keyed into the outer shell of the housing to provide lateral support while permitting axial movement, and interleaving elements are formed on the juxtaposed sidewalls of the buttons within the housing to substantially prevent interbutton light leaks. As a result, the buttons are spaced very closely, and there is no limitation on the size of the symbols or legends other than the dimensions of the button face itself.

BRIEF DESCRIPTION OF THE DRAWINGS

FIG. 3 is a partial sectional view along a longitudinal axis of the array. FIGS. 4 and 5 are sectional views along lines 4—4 and 5—5, respectively, as defined in FIG. 3.

DETAILED DESCRIPTION OF THE DRAWINGS

Figure 1:
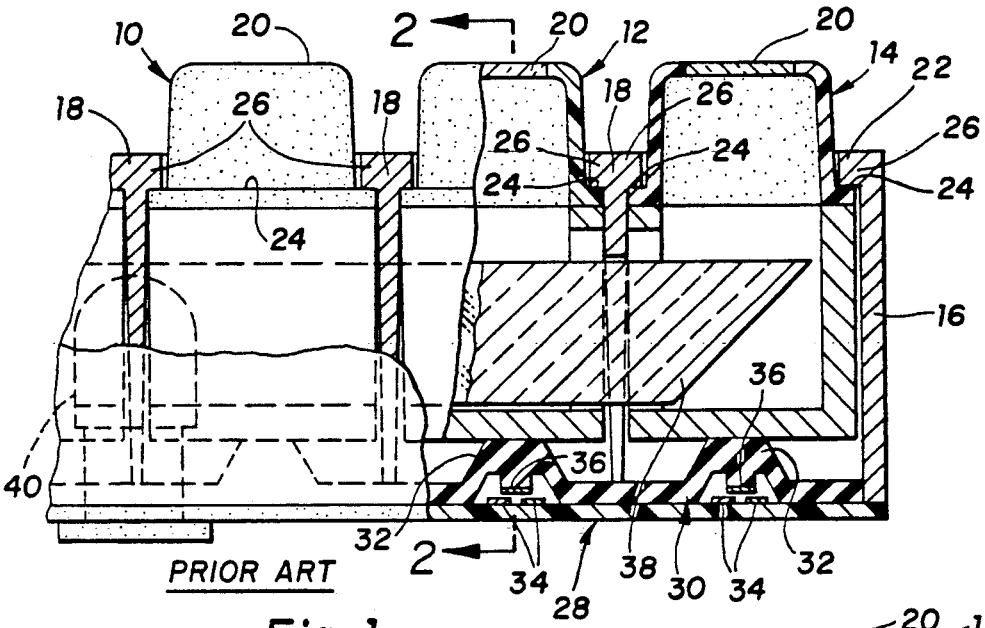
PRIOR ART Fig. 1
FIGS. 1 and 2 depict a conventional serial array of push buttons in a vehicle switch panel.
Figure 2:
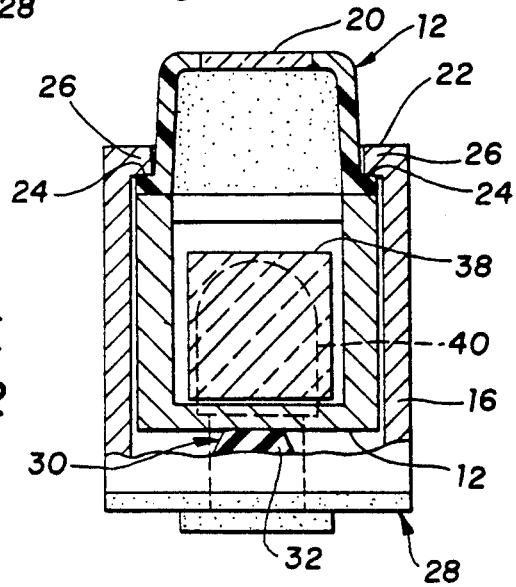
PRIOR ART Fig. 2

Referring to FIGS. 3–6, it will be seen that the array elements common to the conventional array of FIGS. 1–2, such as the circuit board 28 and membrane 30, have been assigned like reference numerals, and will not be re-described below. Other similar elements include the lightpipe 38 and the lamp 40.

The illustrated embodiment depicts the present invention as a serial array of three independently activated push buttons 50, 52 and 54 contoured to resemble a conventional rocker or toggle switch. The buttons 50–54 are retained within a housing 56. As in FIGS. 1–2, the outboard faces 58–62 of each button protrudes through an aperture in the outboard face 64 of the housing. As in the conventional array of FIGS. 1–2, the buttons 50–54 are shown as an assembly of two parts which are glued, heat welded, or otherwise fastened together: a cap portion which protrudes through the housing aperture and an actuator portion which engages the membrane dome 32. For the purpose of this disclosure, however, the buttons 50–54 are considered as a single part.

Figure 3:
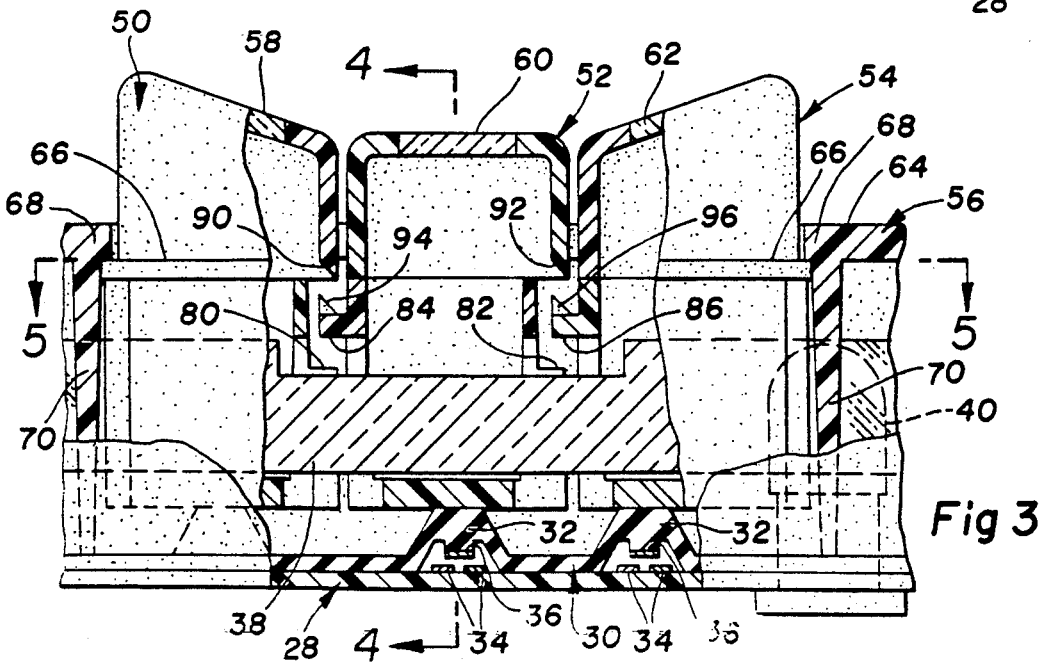
FIGS. 3, 4 and 5 depict a serial array of push buttons according to this invention.
Figure 4:
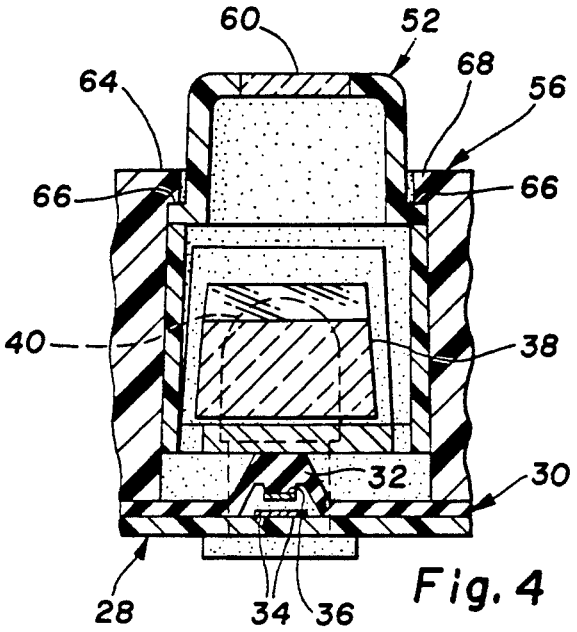
Figure 6:
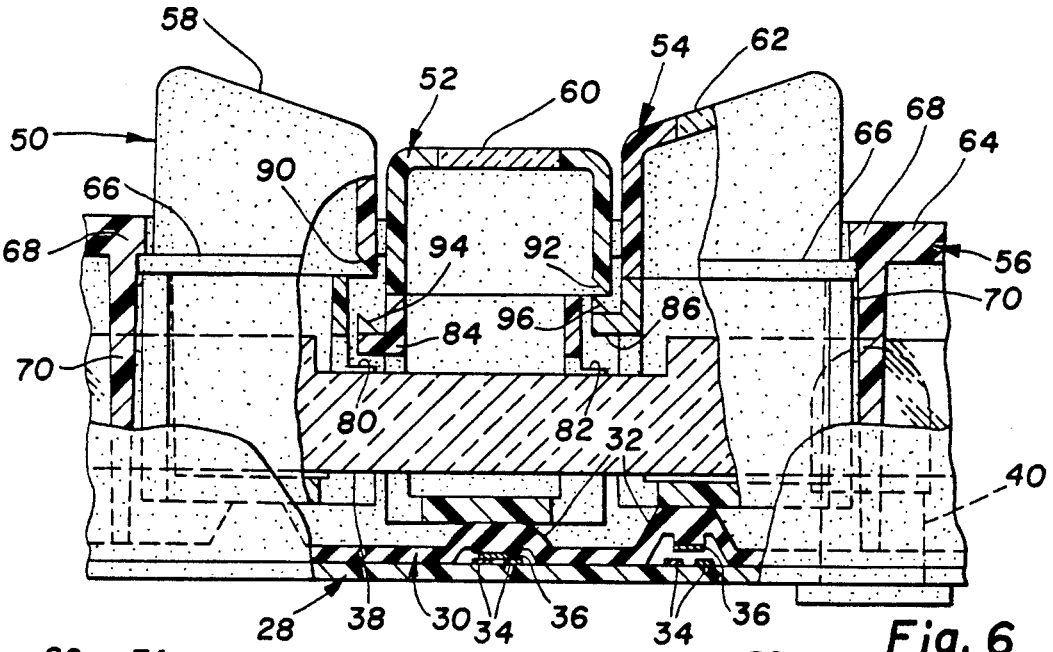
FIG. 6 is a partial sectional view of the push button array of FIGS. 3–5, but with one of the buttons depressed.

As best seen in FIG. 4, outboard movement of the buttons 50–54 is limited by engagement of laterally extending button surfaces 66 with complementary flanges 68 formed on the housing 56. A similar arrangement is employed at each end of the array as best seen in FIGS. 3 and 6.

Figure 5:
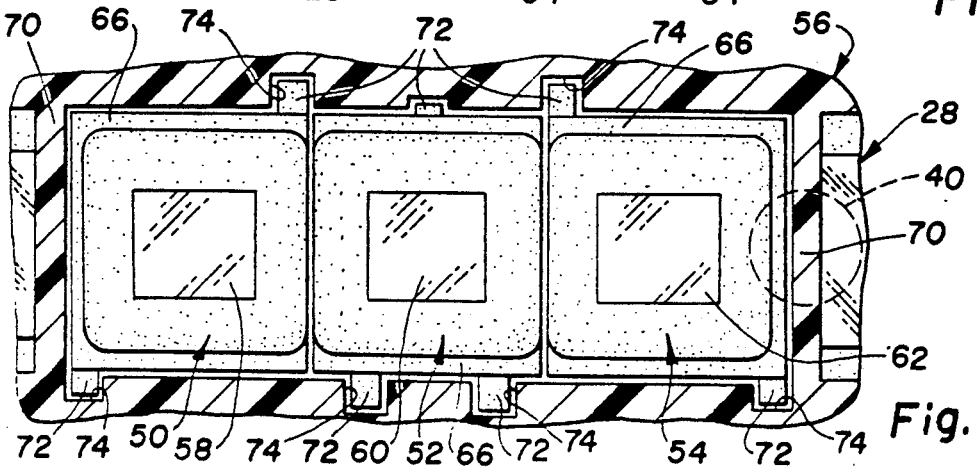

As best seen in FIG. 5, buttons 50–54 are retained both laterally and longitudinally within a housing 56 while permitting axial movement therein. The buttons are retained laterally by the inboard sidewalls 70 of the housing, and longitudinally by a key/keyway coupling between the housing 56 and each button. In the illustrated embodiment, each button 50–54 has two or more ribs 72 formed on each lateral side thereof below the button surfaces 66, and corresponding keyways 74 are formed in the housing 56.

With the above-described arrangement, the sidewalls of adjacent buttons 50–52 or 52–54 can be clearance only to ensure free independent axial movement of the buttons. Moreover, the sidewalls of the button faces 58–62 are straight, so that the legends or symbols will be adequately illuminated even if they extend to the longitudinal edge of the button faces.

The light-trapping function performed in the conventional array by the compartment walls 18 is achieved in the array of the present invention with interleaving elements formed on the juxtaposed sidewalls of the buttons within the housing 56. In the illustrated embodiment, the buttons 50 and 52 have laterally extending recesses 80 and 82 formed below the button surface 66, and the juxtaposed faces of buttons 52 and 54 have tabs or flanges 84 and 86 which extend in part into the respective recesses 80 and 82.

The axial dimension of the recesses 80 and 82 and the axial position of the tabs 84 and 86 therein must be sufficient to permit unrestricted axial movement of the buttons 50–54 within their normal range of movement. To this end, the tabs 84 and 86 are located approximately at the midpoint of the axial dimension of the recesses 80 and 82 when the buttons 50–54 are in the rest or normal position depicted in FIGS. 3–4. In turn, the clearance in the recesses 80 and 82 above and below the respective tabs 84 and 86 must be at least as great as the button movement required to close the respective switch. In this regard, FIG. 6 depicts the array with the center button 52 depressed so that the conductive patch 36 electrically bridges the conductor path pair 34. In this case, the tab 84 moves substantially into contact with the lower edge of recess 80, and the upper edge of recess 82 moves substantially into contact with the tab 86. Similar relationships are observed when the buttons 50 or 54 are depressed.

Due to the interleaved nature of the recesses 80 and 82 and the tabs 84 and 86, light emanating from the lightpipe 38 is prevented from exiting the array between the buttons 50–54. Additional protection may be achieved by providing complementary angled surfaces 90–96 on the recesses 80–82 and tabs 84–86, as seen in FIGS. 3 and 6. Here, the portion of the tab 84–86 which extends into the respective recess 80–82 has a axial dimension which exceeds that of the remainder of the tab, thereby to more effectively prevent the light in the housing from exiting the assembly between adjacent buttons without limiting the relative axial movement of the tabs 84–86 and recesses 80–82. Consequently, the amount of light escaping between adjacent buttons 50–52, 52–54, due to diffraction, for example is insubstantial and not detectable by the occupants of the vehicle in comparison with the light emitted from the translucent areas of the buttons faces 58–62.

While this invention has been described in reference to the illustrated embodiment, it is expected that various modifications will occur to those skilled in the art. In this regard, it will be understood that button arrays incorporating such modifications may fall within the scope of the present invention, which is defined by the appended claims.

The embodiments of the invention in which an exclusive property or privilege is claimed are defined as follows:

1. A switch panel assembly including a housing having an aperture in one face thereof, a switch array mounted in said housing opposite said aperture to define a housing cavity therebetween, a longitudinal array of partially translucent push button elements disposed in said cavity and extending in part through said aperture, and longitudinal lightpipe means disposed in said cavity for back-lighting said button elements during low ambient lighting conditions, the improvement wherein:

each of the button elements is longitudinally retained by two or more interlocking key and keyway features formed on said housing and lateral sidewalls of said button elements; and juxtaposed longitudinal sidewalls of said button elements have interleaved laterally extending tab and recess features within said cavity which operate to substantially prevent detectable light in said cavity from exiting the cavity between adjacent button elements.

2. A back-lit multiple push button switch assembly, comprising:

housing means having an aperture in a front face thereof;

switch array means mounted on said housing opposite said aperture to define a housing cavity therebetween;

a longitudinal array of juxtaposed push button elements disposed in said cavity and having a partially translucent portion extending through said aperture, each such button being longitudinally retained by two or more axially extending key and keyway features formed on said housing and on lateral sidewalls of said button elements;

lightpipe means extending longitudinally through said cavity for illuminating the translucent portions of said button elements during low ambient operating conditions; and light-trapping means formed on juxtaposed longitudinal sidewalls of said button elements within said cavity for substantially preventing the light in said cavity from exiting the cavity between adjacent button elements.

3. The switch assembly set forth in claim 2, wherein the light-trapping means includes a recess formed in a first one of said juxtaposed sidewalls and a flange formed on a second one of said juxtaposed sidewalls, which flange extends in part into said recess.

4. The switch assembly set forth in claim 3, wherein said part of the flange which extends into said recess extends axially toward the translucent portion of the juxtaposed push button thereby to substantially prevent the light in said cavity from exiting the cavity between juxtaposed button elements without limiting axial movement of said flange relative to said recess.

* * * * *